United States Patent [19]

van Mondfrans et al.

[11] Patent Number: 4,887,527

[45] Date of Patent: Dec. 19, 1989

[54] MAGNETIC BEAM FOR A ROLLER SQUEEGEE OF A ROTARY SCREEN PRINTING INSTALLATION

[75] Inventors: Gerardus H. van Mondfrans, Sambeek; Jacobus F. M. Peters, Ottersum, both of Netherlands

[73] Assignee: Stork Brabant B.V., An Boxm Eer, Netherlands

[21] Appl. No.: 254,184

[22] Filed: Oct. 6, 1988

[30] Foreign Application Priority Data

Oct. 9, 1987 [NL] Netherlands ..... 8702420

[51] Int. Cl.[4] ..... B41L 13/04

[52] U.S. Cl. ..... 101/116

[58] Field of Search ..... 101/114, 115, 116–119, 101/123, 124, 120, 129

[56] References Cited

U.S. PATENT DOCUMENTS 3,495,285 2/1970 Zimmer ..... 101/116
3,889,629 6/1975 Black ..... 101/114
3,902,414 9/1975 Zimmer et al. ..... 101/116
4,103,614 8/1978 Mitter ..... 101/116

*Primary Examiner*—Eugene H. Eickholt
*Attorney, Agent, or Firm*—Kenyon & Kenyon

[57] ABSTRACT

A magnetic beam for a roller squeegee of a rotary screen printing installation including an elongated upper plate on the underside of which a number of magnet coils are attached. The upper plate is connected to a lower container which extends over virtually the entire length of the upper plate and surrounds the magnet coils. The lower container has a projecting journal at each end which rests on a vertically adjustable stop connected to the frame of the printing installation. In order to avoid warping of the magnetic beam as a result of temperature differences, the upper plate is connected to the lower container in such a manner that the upper plate can expand freely in the longitudinal direction. The lower plate has a stop member in its center region between the journals which member interacts with an adjustable stop of the frame. By stressed in order to make the beam insensitive to stresses resulting from temperature differences.

12 Claims, 3 Drawing Sheets

MAGNETIC BEAM FOR A ROLLER SQUEEGEE OF A ROTARY SCREEN PRINTING INSTALLATION

BACKGROUND OF THE INVENTION

The present invention relates to magnetic beam for a roller squeegee of a rotary screen printing installation. In particular, the present invention relates to a unique configuration in which warping of one of the key components is avoided.

One configuration for a magnetic beam includes an elongated upper plate whose longitudinal direction is perpendicular to the direction of advance of the conveyor belt, guided thereover, of the printing installation and on the underside of which a number of magnet coils, which can be energized electrically, are attached. The which upper plate is connected to a lower container which extends over virtually the entire length of the upper plate and surrounds the magnet coils and is provided with openings for natural ventilation along the magnet coils. The the magnetic beam is provided at each end with a projecting journal which rests on a member which is vertically movable and which interacts with an adjustable stop connected to the frame of the printing installation.

With magnetic beams of this type, which are generally broad and long, the problem arises that part of the energy supplied to the magnet coils is converted to heat. This heat must be removed since otherwise an impermissible rise in the temperature of the coils occurs which makes the coils less effective. This heat removal usually takes place by means of natural ventilation, which ventilation is further increased by the movement of the conveyor belt of the printing installation. The disadvantage of this natural ventilation is, however, that a temperature difference arises between the lower side and the upper side of the magnetic beam, This temperature difference results in the magnetic beam having the tendency to warp, which has an adverse effect on the operation of the printing installation.

SUMMARY OF THE INVENTION

According to the present invention a magnetic beam of the abovementioned type has a unique configuration wherein warping which would otherwise result from temperature differences in the beam is prevented in an expedient and simple manner.

Another object of the present invention is to provide a magnetic beam in which the temperature differences are greatly reduced.

According to the present invention an upper plate is connected to a lower container in such a manner that the upper plate can expand freely in the longitudinal direction with respect to the lower container and is fixed in the direction of movement of the conveyor belt with respect to the lower container.

As a result of the cores of the magnet coils incorporated in it, the upper plate will rise most in temperature due to conducted heat. As a result of the construction according to the invention, this plate can freely expand in the longitudinal direction, as a result of which the warping of the magnetic beam is prevented.

Preferably, the upper plate is securely connected to the lower container in the center region and is provided near each of the ends with one or more pins which each engage in a slotted hole extending in the longitudinal direction of the plate, in the lower container.

According to an embodiment of the invention which is preferably used, the lower container, seen in the assembled state, is bent in the vertical plane through its longitudinal axis of symmetry, specifically such that a center section is higher than two ends. Two journals are attached to the lower container and the lower container is provided in the center section with a stop member which interacts with a stop fitted between the two flights of the conveyor belt of the printing installation and connected in an adjustable manner to the frame, the whole such that the lower container, in the operating position, is pressed upwards against at least three stops and is maintained, under pretension, in a straight horizontal position.

In the operating position of the magnetic beam, in which it is pressed upwards, the internal stresses present make the magnetic beam to a high degree insensitive to bending stresses resulting from temperature differences.

In order to reduce the temperature differences in the magnetic beam, insulating blocks are disposed between the upper plate and the lower container defining a number of elongated ventilation apartures between the upper plate and the lower container.

Said insulating blocks prevent heat conduction from the upper plate into the lower container so that temperature differences in the height direction of the lower container and therefore temperature stresses are reduced. On the other hand the natural ventilation is improved because there is no longer an accumulation of heated air inside the magnetic beam under the upper plate.

Preferably, the lower container is manufactured from a material with a low coefficient of expansion. For this purpose, stainless steel is preferably used, which also has the advantage that is is antimagnetic. This choice of material is possible since the beam cannot warp as a result of the bimetal effect.

BRIEF DESCRIPTION OF THE DRAWINGS

The invention will now be illustrated in more detail with reference to the accompanying drawing, wherein.

DETAILED DESCRIPTION

Figure 1:
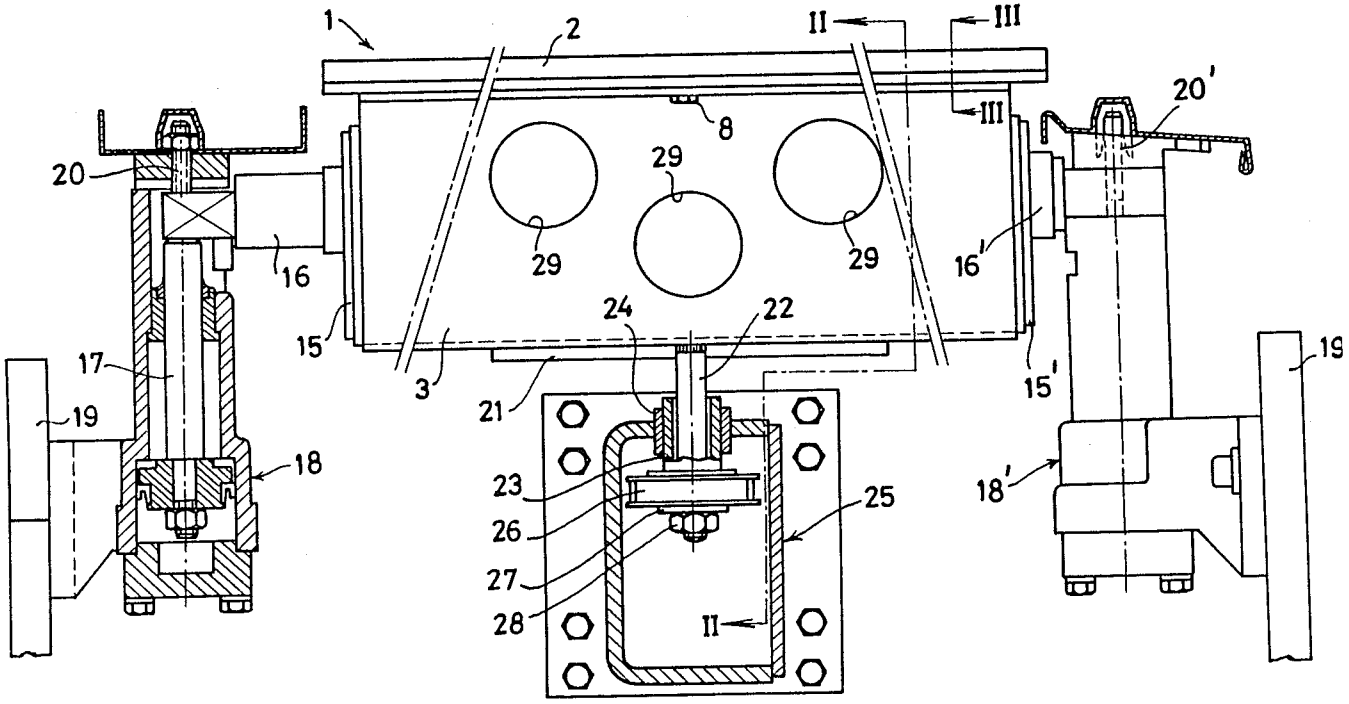
FIG. 1 is a view in partial cross-section of the magnetic beam with its suspension in the frame of the printing installation.
Figure 3:
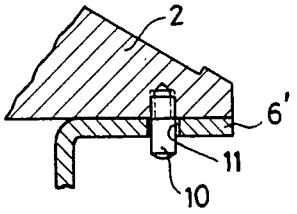
FIG. 3 is a cross-section on an enlarged scale of a detail of the magnetic beam along the line III—III in FIG. 1.
Figure 2:
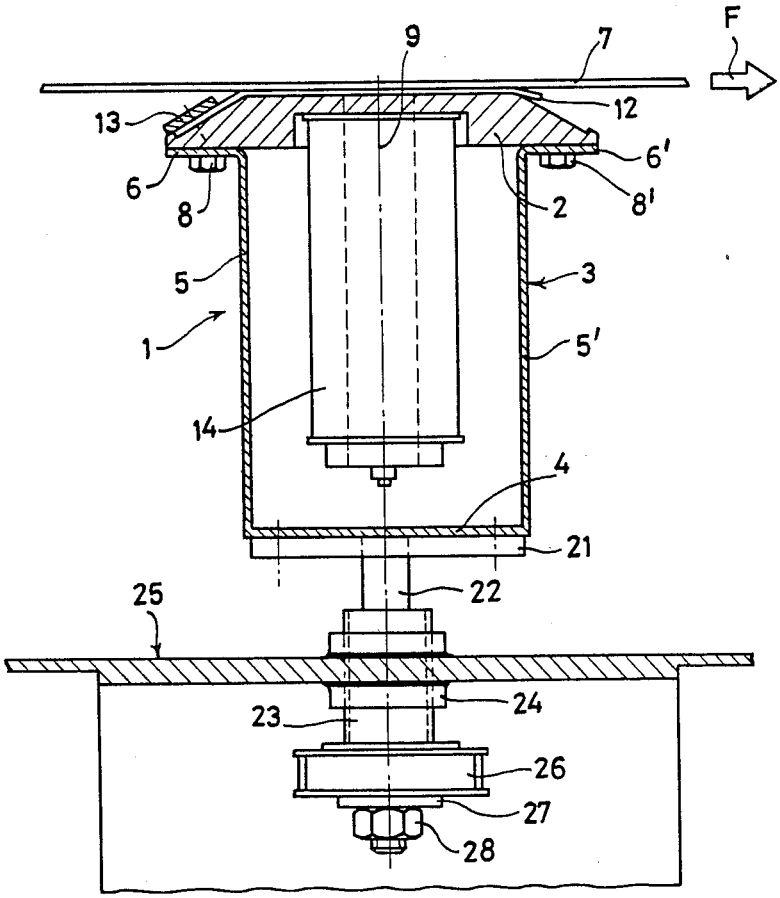
FIG. 2 is a cross-section along the line II—II in FIG. 1.

As may be seen from FIGS. 1 and 2, the magnetic beam, which in its entirety is indicated with the reference numeral 1, consists of an elongated upper plate 2 and a lower container 3 which extends over virtually the entire length of the upper plate. As may be seen more clearly from FIG. 2, the lower container is rectangular in transverse section with a base plate 4 and two side walls 5, 5', the ends of the two side walls being provided with a flange 6, 6' directed outwards. The upper plate 2 rests on these flanges whilst a conveyor belt 7 of the printing installation moves over the upper plate in the direction of the arrow F. In the center of the beam each flange 6, 6' is connected with the upper plate by means of a bolt 8, 8', the two bolts lying directly opposite each other with respect with the line of symmetry 9. Close to the four corners, the upper plate 2 is provided on the underside with a pin 10 which is screwed herein and projects into a slotted hole 11 which extends in the longitudinal direction of the lower container, and is provided near each end of the flanges 6, 6'; see FIG. 3. Overall, there are therefore four of these pins 10 present. The upper plate can therefore expand in the longitudinal direction from the center, where this is securely connected to the lower container 3, the pins 10 allowing a shift of the upper plate 2 with respect to the lower container but fixing the upper plate in the direction of advance F of the conveyor belt 7. The upper plate 2 is, moreover, provided with a slide plate 12 which is attached with a strip 13. The conveyor belt 7 of the printing installation runs over this slide plate. A number of magnet coils 14 which may be excited electrically, by means not shown in the drawing, are attached next to each other to the underside of the upper plate 2.

As FIG. 1 shows, the lower container is provided at both ends with end plate 15, 15' which each carry a projecting journal 16, 16'. The two journals are supported at their ends by a piston 17 of pneumatic cylinders 18, 18', the casing of which is securely connected to the frame 19 of the printing installation. The two cylinders are of a known type and do not constitute part of the invention, so that they will not be described here in further detail. It is important only that the entire magnetic beam 1 can be moved down and up in a vertical direction with aid of these cylinders. In order to limit the upward stroke of the magnet beam, set bolts 20, 20' are fitted which form a stop for the two journals 16, 16'.

A stiffening plate 21, which carries a rod 22 extending perpendicularly downwards, is attached to the base of the lower container 3 in the central section. The rod 22 is moveably guided into a bush 23 which is provided on the outer side with an external screw thread and is screwed into a ring 24 which is fitted on a hollow beam 25 of the frame which is located between the outward and return track of the conveyor belt 7. A pulley 26 is connected to the bush 23 by means of bolts, which pulley is located inside the hollow beam 25. A stop ring 27 which has a larger diameter than the rod 22 and is securely fastened thereto with the aid of a nut 28 is fitted on the end of the rod 22 remote from the stiffening plate 21.

The lower container is also provided, in a conventional manner, with a number of openings 29, which make natural ventilation possible through the inside of the magnetic beam in order to remove the heat generated in the magnet coils.

The magnet beam 1 is illustrated in FIG. 1 in its uppermost position, which means that the journals 16, 16' are pressed against the stops 20, 20' by the pneumatic cylinders 18, 18'. The assembly of the bush 23 and the pulley 26 forms a stop adjustable, in a vertical direction, for the stop ring 27. The height of this stop may be adjusted by rotating the bush 23 with the aid of the pulley 26 via a belt which is driven by an adjustment member which is not illustrated in the drawing. By allowing the magnetic beam 1 to descend by lowering the pistons 17, the rod 22 can slide freely through the bush 23 and the stop comes away from the pulley 26.

Seen in the plane of the drawing of FIG. 1, the lower container 3 is bent in a manner such that, in the lowered position, the central section is higher than the two ends. On bringing the magnetic beam into the high working position with the aid of the pneumatic cylinders 18, 18', firstly the stop ring 27 will come into contact with the stop formed by the assembly of the bush 23 and the pulley 26. On moving the journals further upwards, the lower container will be automatically extended until the correct operating position is achieved in which the journals 16, 16' come up against the stops 20, 20'. Considerable internal stresses prevail in the lower container in this operating position, which completely predominate over possible stresses resulting from temperature differences. In this manner, the magnetic beam is to a high degree insensitive to bending stresses which are caused by temperature differences.

Because the upper plate 2 can expand freely in the longitudinal direction with respect to the lower container 3, it is possible to manufacture the lower container from a material with a low coefficient of expansion. In fact, there is no longer any need to fear the bimetal effect, which would cause additional warping of the magnetic beam. For this purpose, stainless steel is preferably used, which also has the advantage that is is antimagnetic.

Figure 4:
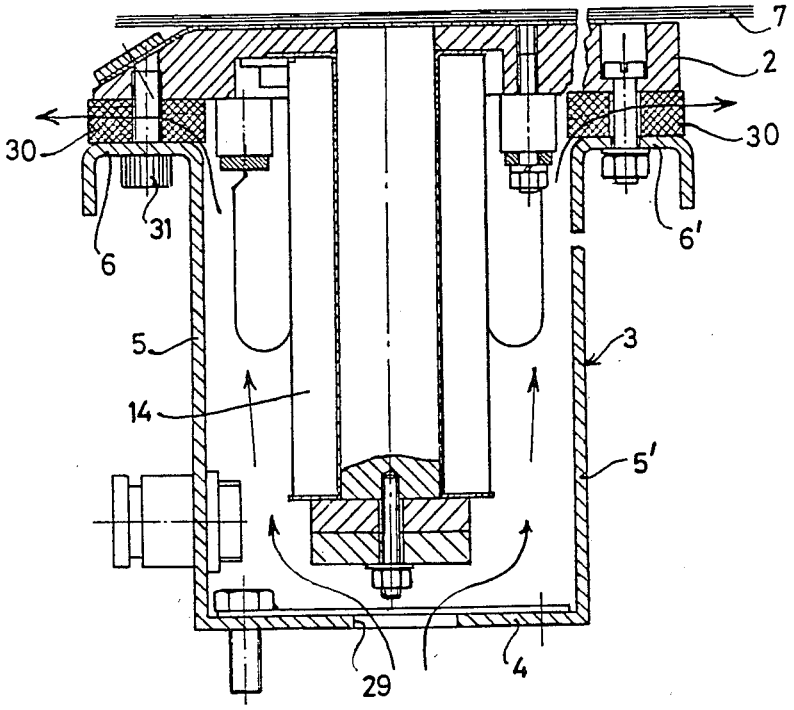
FIG. 4 is a cross-section corresponding to FIG. 2 of another embodiment of the magnetic beam.

FIG. 4 shows another embodiment of the magnetic beam according to the invention in which components are indicated with the same numerals as corresponding components in the other figures.

As can be seen from this figure insulating blocks 30 are disposed between the upper plate 2 and the lower container 3, said blocks defining a number of elongated ventilation apertures. Said blocks are fixedly connected to the flanges 6, 6' for example by means of an adhesive. In a preferred embodiment three of said insulating blocks 30 are arranged on each flange 6 and 6' respectively; a block at each end of the respective flange and one block in the center region.

The blocks in the center region of the flanges are fixedly connected to the upper plate 2 by means of bolts 31, while the upper plate 2 is slideably connected to the blocks 30 at the ends of the flanges 6, 6'. Such a slideable connection is shown at the right side in FIG. 4 and enables the upper plate 2 to expand in the longitudinal direction towards both ends.

As a result of said insulating blocks there is no metal contact between the upper plate 2 and the lower container 3 and therefore no heat transfer from the upper plate towards the lower container. Consequently the temperature difference between the bottom 4 and the flanges 6, 6' will be reduced and so will the tendency of the magnetic beam to warp. Because of the fact that the temperature stresses in the lower container are reduced, the support construction for the magnetic beam can be of a lighter and less expensive construction.

Another advantage of the insulating blocks is an improvement of the natural ventilation. Ventilation air will enter the beam through openings 29 in the side walls 5, 5' or bottom 4 of the lower container 3 and leave the magnetic beam through the elongate apartures between the upper plate and the lower container. In this way an accumulation of heated air in the magnetic beam under the upper plate is effectively avoided.

It will be clear the the invention is not restricted to the embodiment illustrated and described here. Numerous alterations are possible with the scope of the invention, for example with respect to the number and the construction of the stops.

What we claim is:

1. A magnetic beam for a roller squeegee of a rotary screen printing installation having a conveyor conveying articles for a printing operation and a frame including a plurality of stops to prevent excessive movement of the beam and a vertically movable member adjusting a height comprising:

an elongated upper plate, whose longitudinal direction is perpendicular to a direction of advance of the conveyor a plurality of magnet coils disposed on an underside of said upper plate and energized electrically, a lower container connected to said upper plate and extending over virtually the entire length of the upper plate and surrounding the magnet coils and having openings for natural ventilation along the magnet coils, and a projecting journal disposed at each end of the beam and resting on the vertically movable member and which interacts with the adjustable stop connected to the frame of the printing installation, wherein said upper plate is connected to the lower container in a manner such that the upper plate can expand freely in the longitudinal direction with respect to the lower container and is fixed in the direction of movement of the conveyor belt with respect to the lower container.

2. A magnetic beam according to claim 1, wherein the upper plate is securely connected to the lower container in a center region and each of the ends of the upper plate has one or more pins which each engage in a slotted hole extending in the longitudinal direction of the plate in the lower container.

3. A magnetic beam, according to claim 1, wherein the lower container is bent in the vertical plane through its longitudinal axis of symmetry, specially such that a center section is higher than two ends of the lower container, and the lower container is attached to each of the projecting journals and is provided in the center section with a stop member which interacts with a stop fitted between two flights of the conveyor of the printing installation and connected in an adjustable manner to the frame, and further comprising means for pressing said lower container said plurality of stops and said stop member maintaining said lower container under pretension, in a straight horizontal position.

4. A magnetic beam according to claim 1, further comprising an insulator disposed between the upper plate and the lower container and avoiding heat transfer from said upper plate to the lower container.

5. A magnetic beam according to claim 4, wherein said insulator includes spaced insulating blocks defining elongated ventilation apertures between the upper plate and the lower container.

6. A magnetic beam according to claim 5, wherein the insulating blocks are fixedly secured to the lower container, the upper plate in the center region is securely connected to the insulating blocks and, near each of its ends, includes means for slideably connecting said upper plate to the insulating blocks to allow an expansion of the upper plate in its longitudinal direction.

7. A magnetic beam according to claim 5, wherein at each longitudinal side of the lower container three insulating blocks are disposed, a block at each end and one in the center region thereof.

8. A magnetic beam, according to claim 1, wherein said conveyor has flites, the lower container is bent in the vertical plane through its longitudinal axis of symmetry, specifically such that a center section is higher than two ends of the lower container, and the lower container is attached to each of the projecting journals and is provided in the center section with a stop member which interacts with a stop fitted between the flights of the conveyor of the printing installation and connected in an adjustable manner to the frame, and further comprising means for pressing said lower container upwards against said plurality of stops and said stop member, maintaining said lower container under pretension, in a straight horizontal position and an insulator is disposed between the upper plate and the lower container to avoid heat transfer from said upper plate to the lower container.

9. A magnetic beam according to claim 8 wherein the insulator consists of spaced insulating blocks defining elongated ventilation apertures between the upper plate and the lower container.

10. A magnetic beam according to claim 8 wherein the insulating blocks are fixedly secured to the lower container, the upper plate in the center region is securely connected to the insulating blocks and, near each of its ends, includes means for slideably connecting said upper plate to the insulating blocks to allow an expansion of the upper plate in its longitudinal direction.

11. A magnetic beam according to claim 8 wherein at each longitudinal side of the lower container three insulating blocks are disposed, a block at each end and one in the center region thereof.

12. A magnetic beam according to claim 1 wherein the lower container comprises a material with a low coefficient of expansion.

* * * * *